United States Patent [19]

Haltbrekken

[11] Patent Number: 4,747,778

[45] Date of Patent: May 31, 1988

[54] DEVICE IN CONNECTION WITH A SIMULATOR FOR DRILLING RESCUE PROCEDURES

[76] Inventor: Kjell Haltbrekken, Ingebjørgs vei 7, N-7140 Opphaug, Norway

[21] Appl. No.: 12,480

[22] Filed: Feb. 9, 1987

[30] Foreign Application Priority Data

Feb. 18, 1986 [NO] Norway ..... 860604

[51] Int. Cl.[4] ..... G09B 9/02

[52] U.S. Cl. ..... 434/29; 272/17; 272/32

[58] Field of Search ..... 434/29, 30, 3 H, 2 SH; 4/496, 504; 272/16, 17, 32, 49, 71

[56] References Cited

U.S. PATENT DOCUMENTS

| | | | |
|---|---|---|---|
| 2,890,529 | 6/1959 | Cross et al. | 434/30 |
| 3,542,934 | 11/1970 | Warhurst et al. | 434/29 |
| 3,734,613 | 5/1973 | Harpe et al. | 434/34 X |
| 4,221,008 | 9/1980 | Nolan | 4/496 |
| 4,505,472 | 5/1985 | Lorene et al. | 434/34 X |
| 4,588,155 | 5/1986 | James | 4/504 X |

*Primary Examiner*—Richard J. Apley
*Assistant Examiner*—Robert W. Bahr
*Attorney, Agent, or Firm*—Pollock, Vande Sande and Priddy

[57] ABSTRACT

A training device for drilling rescue procedures with crews and passengers in helicopters, aircraft, ships, cars, and the like comprises a cabin that is suspended from a turnable support permitting the cabin to be turned upside-down about a horizontal axis. The device comprises a track, preferably having two rails, that is attached vertically at the edge of a quay, or a ship's side, a raft, or the like adjacent a body of water. A carriage or a sledge is provided that may be driven vertically along the track to a position wherein the carriage and cabin is submerged in the body of water. The turnable support is permanently attached to the sledge or carriage and the cabin is attached to the turnable support in such a manner as to be easily removed, so that the cabin can be replaced by other kinds of cabins in a simple manner.

6 Claims, 2 Drawing Sheets

DEVICE IN CONNECTION WITH A SIMULATOR FOR DRILLING RESCUE PROCEDURES

The present invention relates to a simulator for drilling rescue procedures for crews and passengers in helicopters, ships, cars, and other means of conveyance, comprising a cabin that is suspended from a support for rotation of said cabin about a horizontal axis.

BACKGROUND OF THE INVENTION

In case of an emergency the crew and passengers might easily drown in the cabin of an aircraft or a helicopter ditching or making an emergency landing on water. The same goes for fishermen in the wheel house of a fishing cutter or another small vessel, or for the driver and passengers in cars and coaches landing in water. Personnel in the offshore industry are instructed to take a course in emergency procedures, and fishermen and maritime personnel sometimes attend such courses. Air defence personnel also take courses in emergency procedures. At some places where such courses are held there is equipment for drilling rescue procedures for the crew and passengers in helicopters, aircraft, and ships that end up in water. In order to achieve a situation true to nature the cabin in such simulators is suspended in a support permitting said cabin to be turned 180° about a horizontal axis. The reason for this is that means of conveyance often turn upside down and end up with the bottom up. As regards helicopters, they will always turn about 180° due to the heavy rotor and rotor engine, when a helicopter lands in water. As regards the known devices, separate simulators are built for each type of cabin, and these are lowered into the water in a basin by the aid of hoisting means. This, however, does not offer situations sufficiently true to nature and training is, thus, incomplete. Also it is expensive and bothersome to have one device for each different type of cabin, and there would be a very small number of places where the equipment may be used, since a crane system in connection with a basin will be needed for operating the simulator.

SUMMARY OF THE INVENTION

It is an object of the present invention to provide a device in connection with a simulator of the above mentioned kind, where the above mentioned disadvantages are avoided.

According to the invention this is achieved by a device that is characterized by a track that can be attached vertically to the edge of a quay, a ship's side, a raft, or the like; a carriage or a sledge that may be operated along rails provided on the track, via wheels, sliding blocks, or the like; said turning support being permanently attached to the sledge or carriage; and the cabin being secured to said turning support in a manner permitting it to be easily replaced.

By the aid of the device according to the invention the equipment may be used on the edge of a basin, on the edge of a quay, on a launched raft or a ship. This means that training may occur in sea water out of doors, ensuring the most realistic conditions possible for the drilling. Personnel may wear their survival suits and other rescue equipment normally used during transport by helicopter, and the like, e.g. to and from an oil rig. The procedures may, thus, be drilled under far more realistic conditions than previously, in a swimming pool with heated water, e.g. with the participants wearing swimsuits. This is a great advantage, bearing in mind that there are quite different problems to cope with inside a helicopter, an aircraft, or the like capsizing, e.g. in the North Sea on a winter night at low temperatures, and with personnel having to get out of the cabin at the same time as a large number of other passengers, and with everybody wearing survival suits which hamper movement due to high buoyancy. This buoyancy is an asset in situations where one ends up in water, but it is a great drawback when trying to get out of the cabin. A further advantage of the invention is that the same basic equipment, i.e. track, carriage, and operating means for it and the turning support, may be used for a series of different cabins, wheel houses, etc.

BRIEF DESCRIPTION OF THE DRAWINGS

The invention will now be disclosed in more detail with reference to the drawing which shows an embodiment of the invention.

DESCRIPTION OF THE PREFERRED EMBODIMENTS

Figure 1:
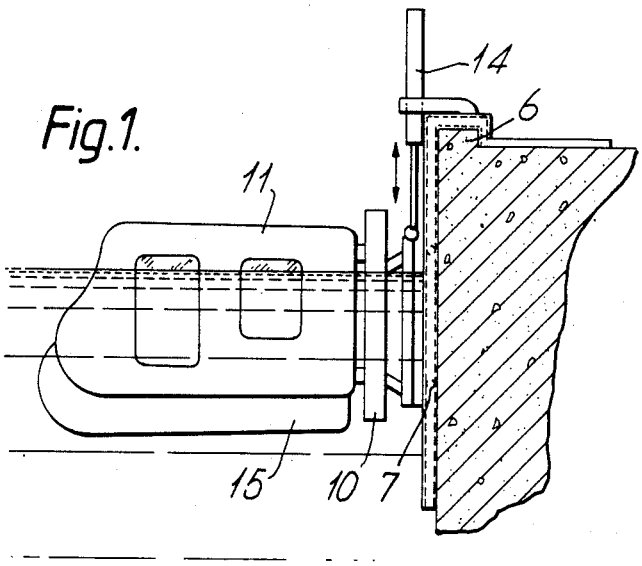
FIG. 1 shows the device according to the invention with a helicopter cabin.
Figure 2:
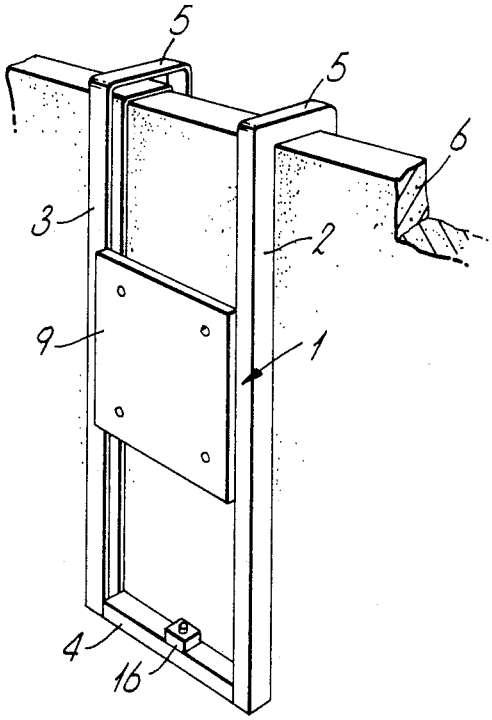
FIG. 2 shows rails with a carriage.
Figure 3:
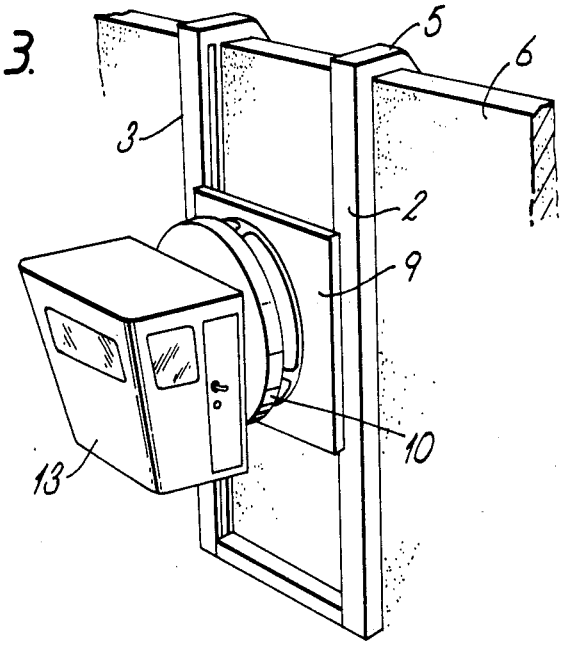
FIG. 3 shows the device according to the invention used in connection with a wheel house of a cutter.
Figure 4:
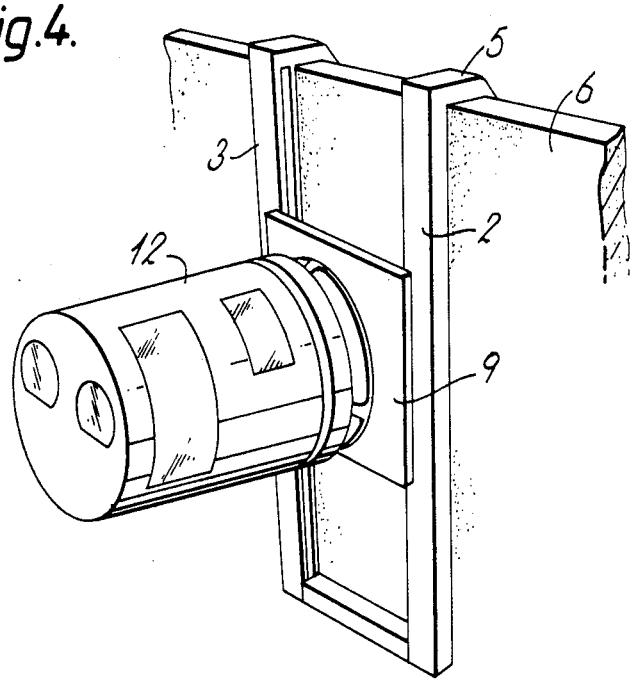
FIG. 4 shows the device in connection with a helicopter cabin.

The device comprises a track 1 with a U-shaped, or C-shaped profile. Said track consists of two rails 2 and 3, which are provided at a mutual distance and are finished with a transversal block 4 at their lowermost ends as well as being provided with hook shaped yokes 5 on top. Said yokes 5 are intended for being clamped over an edge of a quay 6, a gunwale on a ship or a raft, or the like. A carriage or sledge 9 is, via wheels, rollers, slide blocks, or the like, provided in engagement with said rails. Attached to said carriage or the like is a turnable support 10 in such a manner as to permit cabin 11 to be turned 180° from the position shown in FIGS. 1, 3, and 4 into a position with its bottom up. This, of course, is the worst imaginable situation for personnel or passengers in a cabin or a wheel house, and it is a situation occurring when a helicopter lands on water. Cabin 11, 12, or wheel house 13 is fastened to turning device 10 in such a manner as to be easily released, e.g. by bolted joints.

Carriage 9 and turning device 10 with its mounted cabin 11, 12, or 13 can be moved up and down along track 1 by a hydraulic cylinder 14. Turning may be effected by providing said device with a drive ring which is driven, via sprockets, e.g. by a submersible hydraulic motor, or in the simplest manner by providing said cabin with a floating body 15 at its bottom. When the cabin is lowered, the buoyancy of said floating body, e.g. a watertight tank, will cause said cabin to turn into an upside down position, approximately 180° relative to the position shown in the drawing. On end block 4 a limit-switch 16 is provided, which automatically stops the downward movement of carriage 9.

In order to increase safety when the device according to the invention is used, blocking walls may be erected around said device, e.g. made of a cloth in a light color, so that a limited safety area is formed. Within such a blocked area a raft or a floating stage may be placed and provided with various life-saving appliances. Additionally, it may be necessary to have divers or people used to swimming under water, who can bring personnel out of the cabin in case they panic or are unable to get out from other reasons. The swimmers will also observe the situation all the time and signal the staff on shore, so that the device can immediately be raised above the water level. The cabin used should, thus, be provided with large and quickly opening hatches permitting rapid evacuation of water from the interior of said cabin, so that people dwelling in the cabin after it is taken up from the water should not drown.

I claim:

1. A training device for use in providing rescue procedure drills for the occupants of a land, air or sea means of conveyance that may accidentally become submerged in a body of water, comprising a vertically oriented track mounted adjacent a body of water with a lower portion of said vertical track extending below the surface of said body of water, a carriage mounted for movement in a vertical direction along said track between positions above and below said water surface, a rotatable support mounted on said carriage for rotation through at least 180° about a horizontal axis extending outwardly of said carriage in a direction parallel to said water surface, a cabin attached to said rotatable support for occupancy by persons being trained in said rescue procedures, means for moving said carriage and cabin in a vertical direction along said track, and means for rotating said support and cabin about said horizontal axis, whereby said carriage and cabin can be lowered vertically along said track to a position wherein it is at least partially submerged in said body of water and said cabin can be turned about said horizontal axis to an upside-down position during a rescue procedure drill.

2. The training device of claim 1 wherein said means for rotating said support and cabin about said horizontal axis comprises a submersible hydraulic motor.

3. The training device of claim 1 wherein said means for rotating said support and cabin about said horizontal axis comprises a float attached to the bottom of said cabin.

4. The training device of claim 1 wherein said means for moving said carriage and cabin in a vertical direction along said track comprises a hydraulic cylinder.

5. The training device of claim 1 wherein said rotatable support is attached to a substantially vertical end wall of said cabin by readily releasable connectors, to facilitate the attachment and detachment of any one of several different types of cabin to said rotatable support.

6. The training device of claim 1 wherein said track comprises at least two spaced, vertically extending rails along which said carriage is vertically movable, and limit means disposed adjacent the lowermost ends of said rails for automatically stopping downward movement of said carriage and cabin along said rails.

* * * * *